US005921036A

United States Patent [19]

Murphy

[11] Patent Number: 5,921,036

[45] Date of Patent: Jul. 13, 1999

[54] DRIVE-THROUGH RESTAURANT

[76] Inventor: Michael T. Murphy, 4035 30th Ave. SW., Montevideo, Minn. 56265

[21] Appl. No.: 08/648,368

[22] Filed: May 15, 1996

[51] Int. Cl.[6] ..... E04H 3/02

[52] U.S. Cl. ..... 52/169.1; 186/41; 404/71

[58] Field of Search ..... 52/36.1, 169.1, 52/36.2, 27; 315/158, 159; 186/37, 41, 53, 44; 404/71, 77, 79, 95

[56] References Cited

U.S. PATENT DOCUMENTS

| | | | |
|---|---|---|---|
| Re. 24,723 | 10/1959 | Cornwell | 52/169.1 |
| 2,648,300 | 8/1953 | Beedle | 186/37 X |
| 2,722,179 | 11/1955 | Belew | 186/37 X |
| 2,949,870 | 8/1960 | Graber | 186/37 X |
| 3,294,342 | 12/1966 | McClure et al. | 186/37 X |
| 3,774,723 | 11/1973 | Johnston | 186/36 |
| 4,158,999 | 6/1979 | Sukolics | 186/41 X |
| 4,225,808 | 9/1980 | Saraceni | 315/307 |
| 4,245,720 | 1/1981 | Neill, Jr. | 186/38 |
| 4,270,319 | 6/1981 | Spasojevic | 52/36.2 |
| 4,675,515 | 6/1987 | Lucero | 186/41 |
| 4,735,289 | 4/1988 | Kenyon | 186/53 X |
| 4,805,360 | 2/1989 | Kuehnl | 52/169.1 |
| 4,873,469 | 10/1989 | Young et al. | 315/158 X |
| 4,884,662 | 12/1989 | Cho et al. | 186/41 X |
| 5,021,715 | 6/1991 | Smith et al. | 315/159 |
| 5,113,974 | 5/1992 | Vayda | 186/53 X |
| 5,287,948 | 2/1994 | Casale et al. | 186/41 |
| 5,293,097 | 3/1994 | Elwell | 315/159 X |
| 5,416,385 | 5/1995 | Hau | 315/158 X |
| 5,498,931 | 3/1996 | Bedocs | 315/158 |
| 5,552,676 | 9/1996 | Viljanen | 315/158 X |
| 5,557,173 | 9/1996 | Kuo | 315/158 |
| 5,700,385 | 12/1997 | Jones | 404/71 |

*Primary Examiner*—Michael Safavi
*Attorney, Agent, or Firm*—Moore & Hansen

[57] ABSTRACT

A drive-through window station of a restaurant has a food preparation area adjacent a food preparation viewing window. A driveway exterior the window positions a customer in a vehicle at an enhanced elevation whereby the customer may look inward and downward to view and direct the food selection, preparation and packaging by continuous communication using one or more spaced two-way speaker-microphones units. A canopy over the driveway enables proper lighting to view the interior food preparation. Sensor activated lighting increases the interior and/or exterior illumination when a vehicle enters the driveway, and decreases the interior and/or exterior illumination when a vehicle exits the driveway.

45 Claims, 6 Drawing Sheets

DRIVE-THROUGH RESTAURANT

BACKGROUND OF THE INVENTION

This invention relates generally to drive-through structures. More particularly, this invention pertains to a drive-through restaurant and a window station therefor.

Restaurants may be classified according to the method of food delivery to customers. A standard eat-in restaurant provides tables and seating for customers, and the food order may be picked up at a counter by the customer, or delivered to the customer's table by a restaurant employee.

Drive-in restaurants provide parking space for customers wishing to eat in their vehicles while parked at the restaurant. Food orders are delivered to the vehicle by a restaurant employee.

Drive-through restaurants are a more recent phenomenon than drive-in restaurants. Typically, a driveway is provided with a menu chart and a two-way speaker/microphone combination near the beginning of the driveway, for placement of orders from the customer's vehicle. After placing an order, the customer then may drive the vehicle to a delivery window to pay for, and receive, the order but will not witness the preparation of the order.

Restaurants combining features of eat-in, drive-in and drive-through may be found. Often, drive-through restaurants have a conventional interior table seating area for those not wishing to eat in their vehicles.

A primary advantage of the drive-through restaurant is that a limited number of menu items may be kept ready for immediate sale and high volumes of such food items can be prepared and sold with minimum restaurant space and a minimum number of employees. Little parking space is required, and theoretically, a customer may order and receive a meal in minimum time, without leaving a vehicle.

The present drive-through restaurants designs function effectively where the menu has standard items and little customization is required, but is not well suited when many food variations are provided.

There are numerous drawbacks to the conventional drive-through restaurant construction.

First, if a customer wishes to change an order after passing the menu board, no communication with a restaurant employee is usually available until the delivery window is reached. The customer is for all practical purposes prevented from returning to the menu board by other waiting vehicles positioned to the rear of the customer.

Second, when a customer wishes to change an order, the already-prepared meal must then be set aside, and a new order substituted, resulting in delay to the customer as well as to following customers.

Third, the rejected meal is a cost burden to the restaurant.

Fourth, the customer cannot see the meal being prepared, so cannot oversee the preparation to ensure that the meal is as ordered.

Fifth, the customer cannot oversee the packaging of the meal to ensure that sufficient condiments, napkins, etc. are included.

Sixth, in present systems, customers sometimes feel compelled to open and inspect the meals before leaving the delivery window, to confirm that they are as ordered, and that the desired condiments, napkins, utensils, drinks, etc. have been included. Often, this results in reordering of a meal and/or a request for additional ancillary items. This post-delivery inspection and re-order slows the departure from the delivery window, delaying following customers and reducing overall throughput. An extended waiting period discourages subsequent patronization and results in a net customer loss.

Seventh, the restaurant can do nothing to encourage additional customer purchases once the order is taken and the customer has left the menu board and its communication system.

Eighth, in restaurant arrangements where the customer sees no food products during the time interval he spends between the menu board and the delivery window, there is little chance that the customer will increase his order. By contrast, if the customer sees an array of food products the likelihood of additional compulsive food purchases increases substantially.

Each of the above disadvantages of conventional drive-through restaurants is exacerbated when the menu includes complex custom assembled items such as deli-style "sub" sandwiches having a variety of optional breads, meats, vegetables, sauces, cheeses and toppings, for example.

Thus, new restaurant features are required for eliminating preparation errors, accommodating the desires of customers, minimizing the time between ordering and delivery, and expanding food sales.

A major purpose of the invention is to increase customer satisfaction by involving the customer in meal choices and preparation from start to finish. This results in more satisfied customers and increased business for the restaurant.

BRIEF SUMMARY OF THE INVENTION

The invention comprises an improved drive-through restaurant having a window station whereby a customer may order a meal item(s), oversee and direct the preparation of the meal item(s) and pay for and receive the meal item(s) without leaving a vehicle. The invention is particularly advantageous for restaurants serving prepared foods, bakery goods, individualized food products, cafeterial or deli-style custom-made sandwiches such as "subs" and the like which comprise a wide choice of breads, meats, cheeses, vegetables, sauces, etc. The invention is useable with a wide range of foods and or retail merchandise any of which can be displayed in a window viewed by the occupants of a vehicle including, inter alia, hamburgers, pizza, chicken, ice cream, yogurt, beverages, assorted sandwiches and the like.

In this improved restaurant construction, a food preparation area is adjacent an elongated viewing window along an exterior wall. A drive-through driveway or ramp passes on the exterior side of the viewing window. The driveway is elevated above the indoor floor level of the restaurant, such that a person in a motor vehicle e.g. an automobile or truck may view, through the window, the food constituents and meal item assembly in the food preparation area. Thus, the customer may view and personally direct the custom assembly and packaging of the meal from start to finish. As a food preparer assembles the food items and moves along the food preparation area, the customer may move the vehicle forward to follow his progress in food preparation from initial ordering through delivery.

Two-way communication means such as a combination speaker/microphone or intercom is provided so that the customer and food preparer may communicate throughout the entire meal assembly and packaging operations.

After the food is prepared and packaged, the customer may drive the vehicle forward to an openable delivery window for paying the restaurant and receiving the food order without leaving the vehicle.

The customer's personal viewing of and his ability to thus direct the food preparation provides assurance to the customer that the meal is prepared as ordered, any changes or additions are easily made, and the delivered order includes the desired quantities of utensils, napkins, drinks, and condiments such as mustard, ketchup, sweeteners, spices and the like.

A further feature of the invention is an optional canopy over the driveway adjacent the food assembly window and delivery window, for protecting the customer from adverse weather. Thus, the customer may leave the vehicle window open for communication with the restaurant employee during the meal assembly, packaging, payment and delivery steps.

In an added feature, a plurality of lights beneath the canopy is activated by a vehicle sensor to increase brightness when a vehicle enters the driveway and to dim the lights when the vehicle leaves. The two-level lighting provides a visual greeting to a customer and reduces energy consumption when customers are not present.

In a related feature, a vehicle sensor activates an increase in illumination in the restaurant interior over the food preparation area, indicating to the food preparing employee that a customer has entered the driveway, and providing the desired illumination for meal preparation and viewing thereof by the customer. Moreover, where it is desirable to use a tinted window to reduce solar glare and/or solar radiation into the restaurant, the additional internal illumination permits a customer to readily view the food preparation even on bright sunny days.

Additionally, a secondary window may be placed such that an employee may view the incoming end of the driveway, for detecting an incoming vehicle and determining the number of customer vehicles waiting in line. Preferably, this window is placed in an endwall which is aligned at an angle of about 90 to 135 degrees with the viewing window.

Furthermore, another feature of the invention is the utilization of a moving air curtain over either or both viewing windows and over the openable delivery window to discourage insect buildup in response to bright lighting of the area. The air curtain is formed primarily of exterior air passed downward or horizontally over the open window pane, and interior air may be injected into the exterior air to provide hunger-inducing aromas along the driveway.

Other features and advantages of the invention are made clear by the following drawings and detailed description which follow.

BRIEF DESCRIPTION OF THE DRAWINGS

The invention is illustrated in the following figures, wherein the same indicia are used throughout.

DESCRIPTION OF THE PREFERRED EMBODIMENTS

Figure 1:
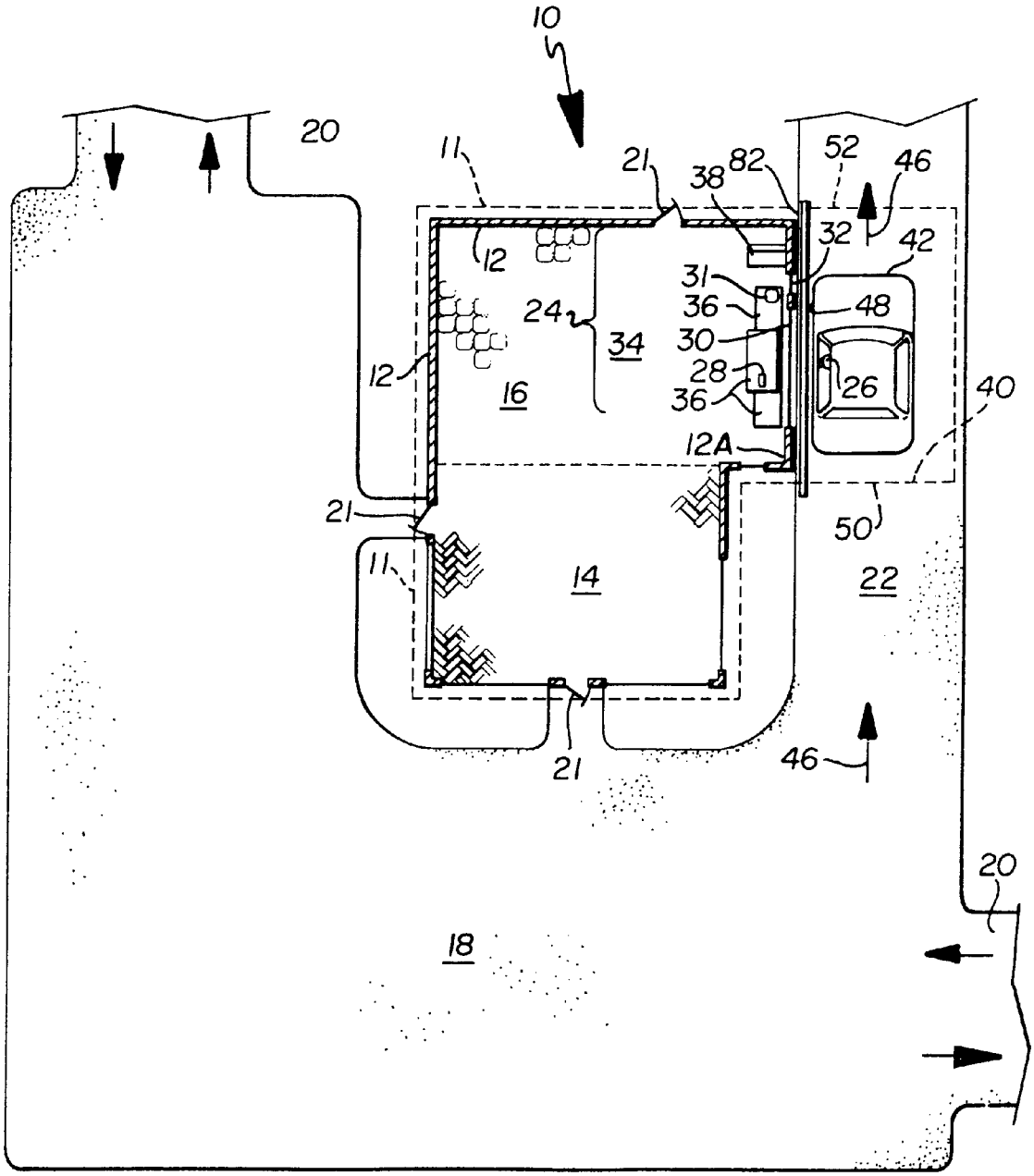
FIG. 1 is a plan view of a combination drive-through and eat-in restaurant of the invention, with adjacent driveway and parking area.

With reference to the drawings, and particularly to FIG. 1, a combination drive-through and eat-in restaurant 10 is depicted having exterior walls 12. The restaurant 10 is shown with an eat-in section 14 and a work section 16 typically adapted for food storage, food preparation, utilities, and administrative functions.

The restaurant 10 is shown with entrances 21 to provide access for customers, employees, etc.

The restaurant 10 is shown with vehicle parking area 18 with street access 20. A drive-through vehicle driveway 22 provides access to a window station 24 where a customer 26 in a vehicle 42 may order a meal item 28 such as a sandwich and view and direct its preparation from a variety of customer-selected food components visible through a viewing window 30 in wall 12A. The meal item 28 is then paid for and delivered to the customer 26 at a delivery window 32.

The driveway 22 is configured for vehicle movement in general direction 46 so that the driver's side 48 of vehicle 42 is adjacent the viewing window 30 for viewing and directing the food preparation.

The interior food preparation area 34 is adjacent the viewing window 30 and includes at least one generally horizontal food preparation surface 36 such as a counter top. The food preparation surface 36 is intended for holding, storing and displaying food ingredients or components and to provide a work surface for preparing a multicomponent food item. It is also useful for packaging the prepared foods, displaying meal accessories such as potato chips, cookies, dessert items, etc. to a customer. A cash register 31 may be placed on a food preparation surface 36 adjacent the delivery window 32 to facilitate billing and payment. In a preferred embodiment illustrated in FIG. 1, a cash register 31 is shown adjacent a delivery window 32 on surface 36 for accepting payment from a customer 26 and delivering the ordered food 28.

FIG. 1 also shows a drink preparation area 38 which may hold a drink dispenser. The drink preparation area 38 may also be used to hold condiment containers, napkins, or other items as desired.

Figure 2:
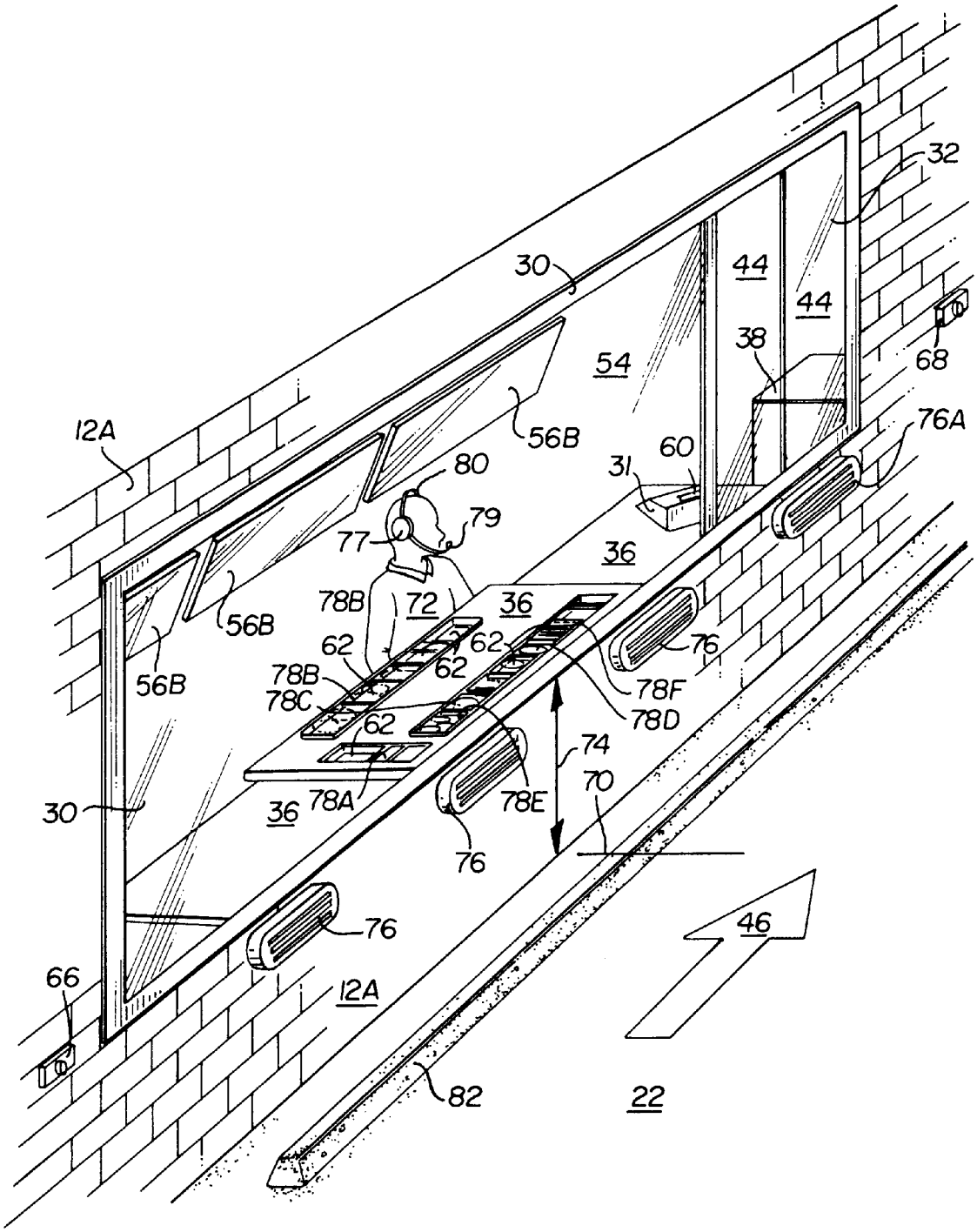
FIG. 2 is a perspective view of a drive-through restaurant window station of the invention.

As best shown in FIG. 2, the delivery window 32 may have two panes 44, at least one of which is openable, for example by sliding.

In FIG. 1 the wall 12A, food preparation area 34, viewing window 30, driveway 22, delivery window 32 and features associated therewith, both interior and exterior the restaurant 10, are together denoted herein as the drive-through restaurant window station 24.

Figure 4:
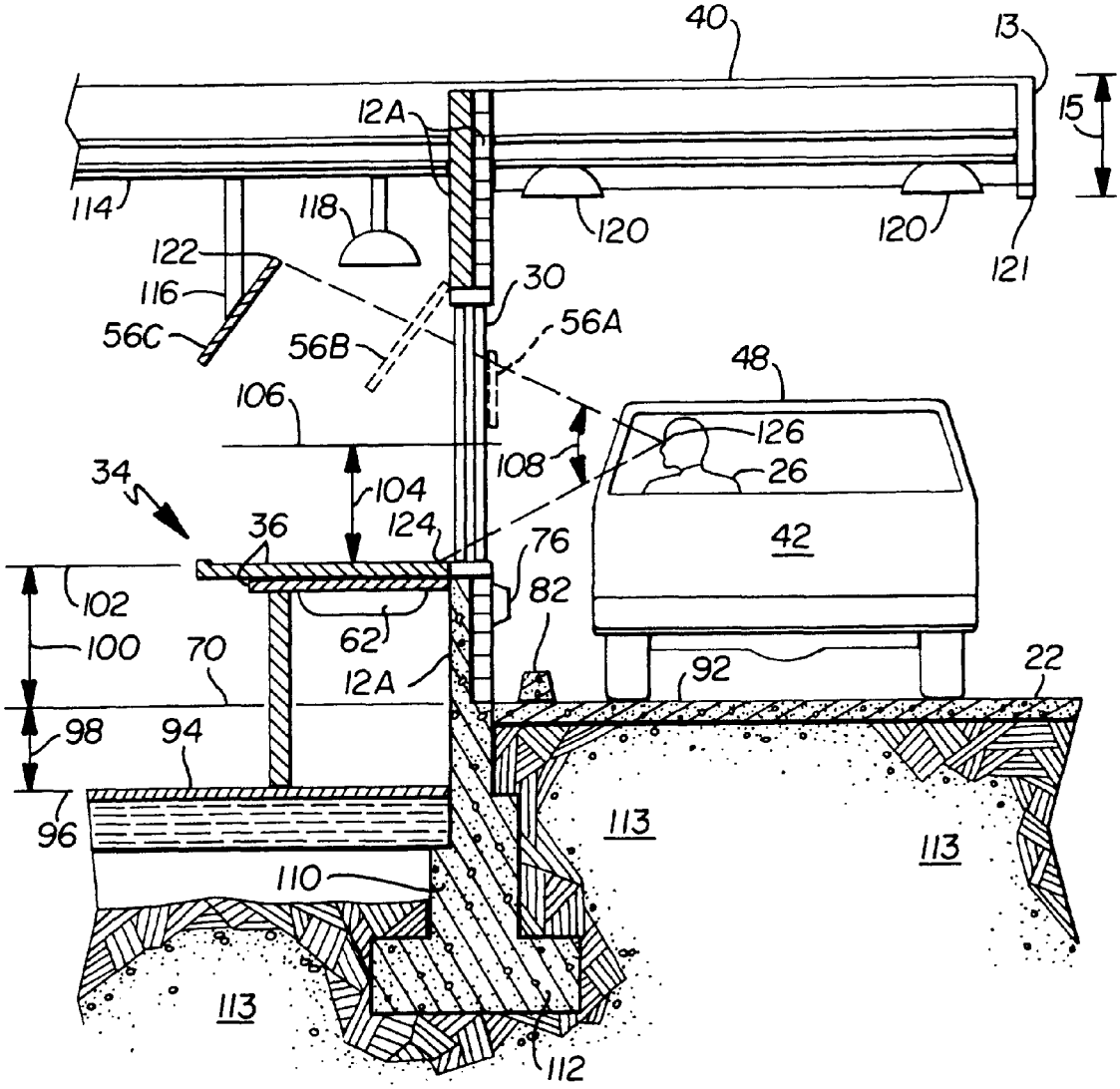
FIG. 4 is an end view of a drive-through restaurant window station of the invention, as taken along cutting plane 4—4 of FIG. 3.
Figure 5:
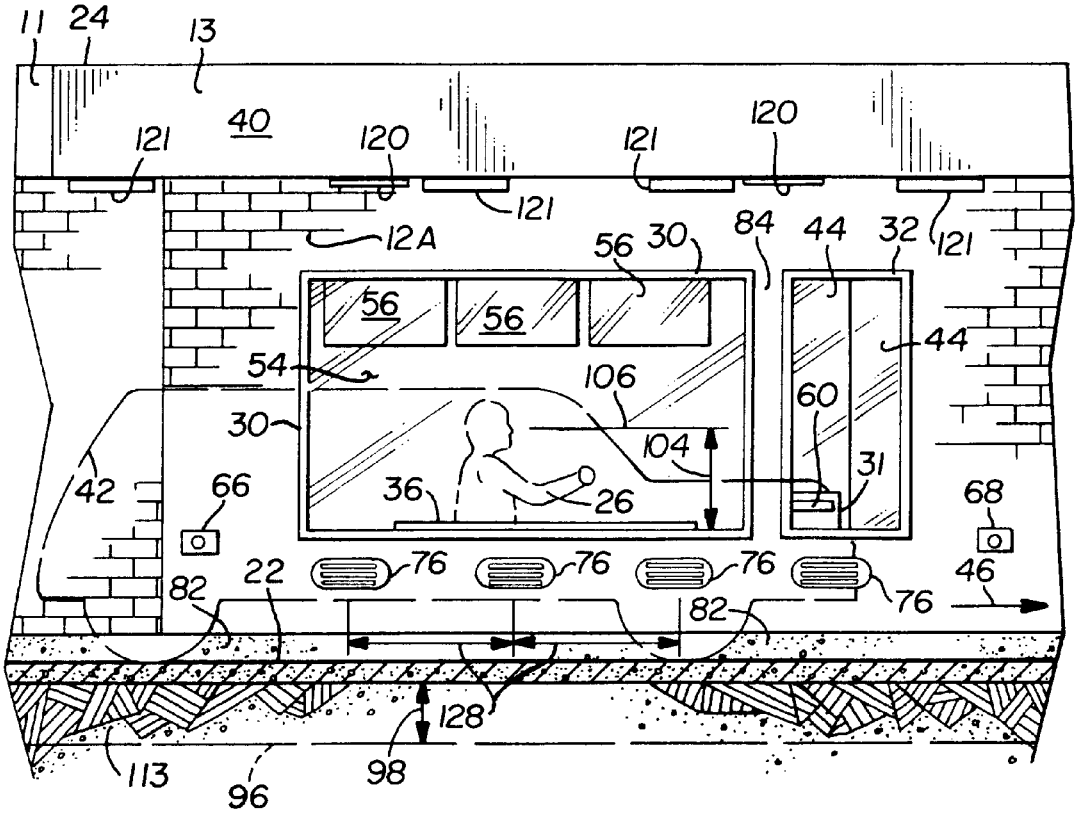
FIG. 5 is a side view of a drive-through restaurant window station of the invention with a customer vehicle shown in phantom.

For purposes of illustrating an example of the invention, the restaurant 10 is shown as flat-roofed with an exterior projecting overhang 11 having a decorative vertical face 13 (see FIGS. 4 and 5). The overhang 11 is near the upper portion of the vertical walls 12. The figures also illustrate a canopy 40 over the driveway 22 adjacent windows 30 and 32. In this example, the canopy 40 may be an outward extension of the overhang 11, having the same decorative vertical face 13. The canopy 40 provides protection to the customer 26 from inclement weather, blowing dust, etc., and serves other purposes as will be further described. The canopy 40 is generally at least 9 feet above the driveway 22 for passage of various sized vehicles.

The invention may be adapted to buildings having other types of roof and wall constructions.

While the invention is described as being part of a combination drive-through/eat-in restaurant 10, the restaurant may be configured for drive-through service only. It is understood that the term "drive-through" also anticipates the servicing of pedestrians walking up to order food from the restaurant window station 24.

Turning now to FIG. 2, an external view of the restaurant window station 24 is shown from the entrance end 50 thereof looking toward the exit end 52 thereof (see FIG. 1).

The elongate viewing window 30 is positioned in wall 12A and extends longitudinally upwardly from the height of the food preparation surface 36. Viewing window 30 (FIG. 2) is shown as a non-opening unitary window with one or more parallel coextensive panes 54 of substantially transparent glass or plastic. In an alternative arrangement, not shown, viewing window 30 may comprise a plurality of window sections, the sum of which is generally equivalent in overall dimensions to the single window shown in the figure. A minimum number of panes is preferred for achieving an unobstructed view for the customer 26.

Visible through viewing window 30 of FIG. 2 are one or more menu boards 56B for viewing by a customer 26. The menu boards 56B are positioned for optimal viewing by the drive through customer 26. In alternative arrangements, the menu board(s) may alternatively be mounted (a) exterior of the window 30, shown as menu boards 56A (FIG. 4), (b) just inside the window 30 as shown in FIGS. 2 and 4 as menu boards 56B, or (c) spaced rearwardly from the window 30, as exemplified by menu boards 56C in FIG. 4. As shown, the menu boards 56A, 56B or 56C may be located at an elevated position requiring a customer to look somewhat upwardly to read the menu. Menu boards 56A, 56B and 56C are shown with a tilted attitude to face the customer 26. The menu boards may be back lit with an appropriate amount of lighting to illuminate the menu face.

Also located adjacent the inside surface of windows 30 and 32 are food preparation surfaces 36 and drink dispensing counter 38. Counter 38 may also be used to display additional food items, or dispense condiments, napkins, utensils, and the like. For purposes of illustration, the food preparation surfaces 36 may include subsurface containers 62, optionally heated or cooled, for holding, displaying and preserving food components 78 within the view of customers 26. The food components 78 may be arranged in any order and be comprised of such items as breads 78A, lettuce 78B, meats 78C, specialty meats 78D, tomatoes 78E, onions 78F, etc. as well as butter, mayonnaise and/or sauces and/or other food items to be provided to customers for purchase or in addition to the original order.

The number, opening size, depth and heating or cooling capability of the containers 62 may vary widely, including any suitable number or type of food components 78 helpful to preparing the meals. Visibility of the food components 78 and subsurface containers 62 is important for the customer to select those items for the meal item 28. If desired, labels designating each contained component 78 may be adjacent each container 62, visible to the customer. The visible presentation of accessory food items such as potato chips, crackers, cookies, dessert items, and the like enables customers to select side dishes, snack foods and dessert dishes to accompany the meal. The container arrangement can be easily adjusted to meet the ever changing food offerings of the restaurant.

Delivery window 32 is shown as having two panes 44, at least one of which slides between open and shut positions for receiving payment and delivering the ordered food. A cash register 31 is shown positioned adjacent window 32 on food preparation surface 36. The cash register 31 may have a price indicator 60 located inside or outside the building within view of the customer.

Exterior of the wall 12A, the vehicle driveway 22 is shown as positioned proximate wall 12A and restaurant viewing window 30 so that the customer, e.g. driver or rider 26 may view the menu boards 56B. An arrow 46 is shown painted on driveway 22 for directing vehicles 42 in the direction indicated. A vehicle entrance sensor 66 and a vehicle exit sensor 68 detect the presence of a vehicle 42 and control the exterior and/or interior lighting of the window station 24, as will be further explained.

It is critical to this invention that the driveway elevation 70 (FIGS. 2 and 4) at the window station 24 is such that a vehicle driver 26 may look downward through viewing window 30 to clearly view the food preparation surfaces 36 with food components 78 and containers 62 being used by a food preparer 72. Thus, in accordance with this invention, the food preparation surface 36 is elevated above the driveway elevation 70 by about 16 to 33 inches, but in general the elevation difference 74 does not exceed about 36 inches as a maximum.

Also shown in FIG. 2 is an intercom unit, i.e. combination speaker/microphone unit 76 mounted on wall 12A just below viewing window 30, for two-way communication between a customer 26 and a restaurant employee, e.g. food preparer 72. While a single speaker/microphone unit 76 may be used if it has a wide range, a plurality of speaker/microphone units 76 may be spaced apart and installed on exterior wall 12A. Such installation is further described in relation to FIG. 5. The food preparer 72 may use a head set 80 containing a microphone 79 and speaker(s) 77. A curb 82 is shown on driveway 22 to protect the speaker/microphone unit(s) 76 and wall 12A from vehicles 42. A speaker/microphone unit 76A is shown installed at or near the delivery window 32 for communication between the paying customer and a cashier.

Figure 3:
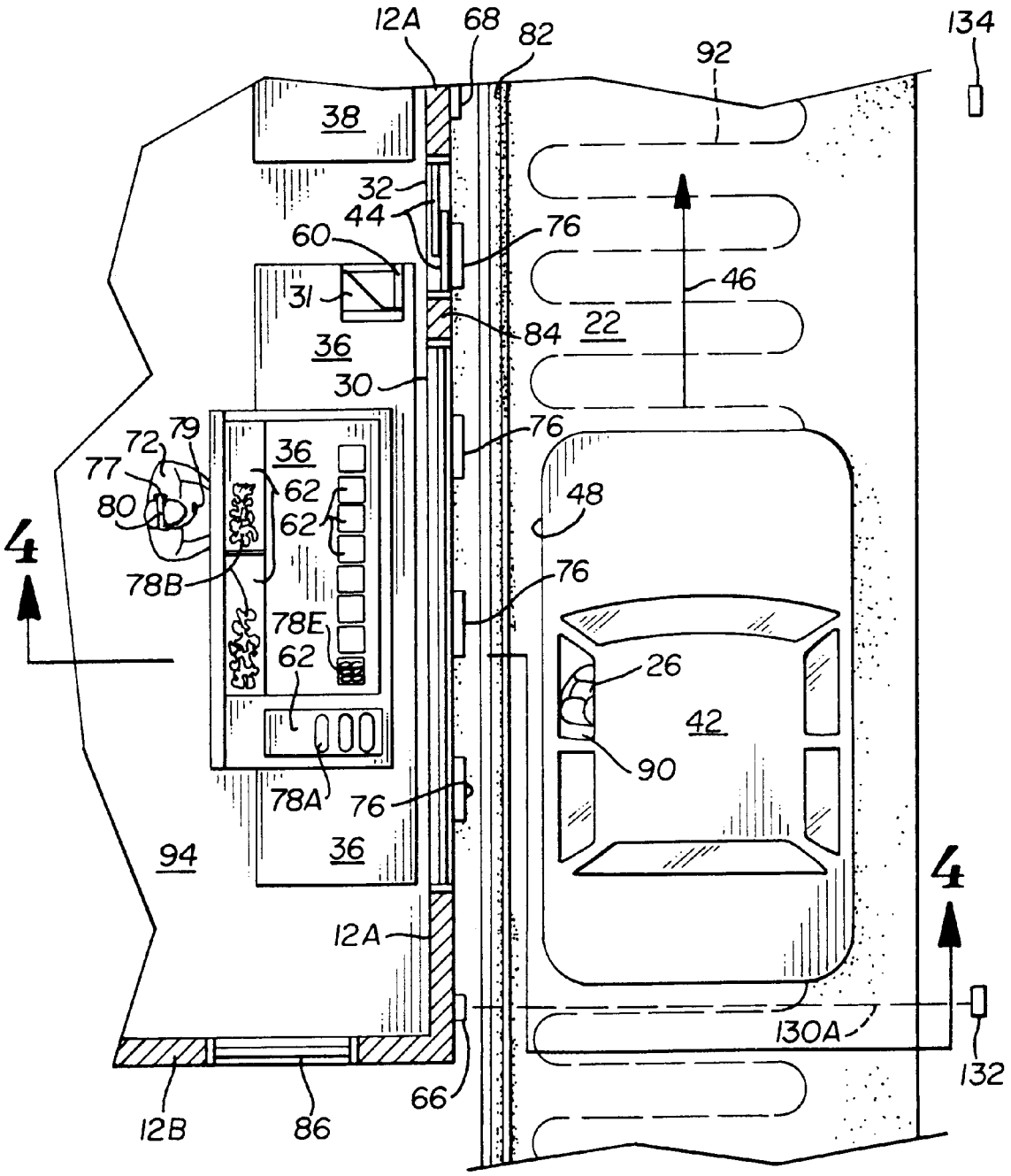
FIG. 3 is an enlarged top plan view of a drive-through restaurant window station of the invention.

In FIGS. 3–5, various aspects of an embodiment of the drive-through window station 24 are illustrated.

In FIG. 3, a drive-through window station 24 is both interior and exterior a restaurant wall 12A. Viewing window 30 and delivery window 32 are mounted in wall 12A, and are shown with a narrow divider 84 therebetween. Viewing window 30 is shown as being non-openable, while delivery window 32 may be opened for transfer of payment money and food therethrough.

Also shown is a relatively small traffic view window 86 in restaurant wall 12B, providing a food preparer 72 or other restaurant employee with a view of incoming vehicles 42 on driveway 22. Window 86 is angularly disposed to window 30, typically at a right angle thereto.

Within the restaurant 10, adjacent to viewing window 30 FIG. 3,) are shown food preparation surfaces 36 and drink dispensing counter 38. A cash register 31 with price indicator 60 is shown on the food preparation surface 36 adjacent delivery window 32. The working surfaces are positioned at an elevation facilitating use by a standing food preparer 72, and are shown as including subsurface containers 62 as previously described. Other containers may be placed on the food preparation surfaces 36 or drink dispensing counter 38, for containing food components 78 in any order of arrangement.

The vehicle 42 with driving customer 26 is shown in position for ordering food, the driver's side 48 of vehicle 42 being proximate the viewing window 30 so that an order may be placed by the customer 26 through an open vehicle window 90 via one or more wall-mounted combination speaker/microphone units 76. The use of a plurality of such speaker/microphone units 76 spaced along wall 12A enables a customer 26 to communicate continuously with a food preparer 72 to supervise the food preparation and packaging. Thus, as the food preparer 72 moves along the food preparation counters 36 toward the counter 38, the meal is progressively prepared, and the customer 26 may move vehicle 42 forward to follow the food preparer 72 without losing voice contact. Thus, the customer 26 may both visually and orally confirm that the particular food is prepared as ordered, reducing the chance for errors.

The speaker/microphone units 76 are preferably positioned immediately below the viewing window 30 or may be installed in or on the viewing window 30 itself to more closely approximate the level of the open vehicle window 90. In the latter case, the speaker/microphone units 76 may be wireless, and should be as small as possible to avoid blocking the customer's view through window 30.

The speaker/microphone units 76 may be horizontally spaced from about 2 to about 10 feet apart, depending upon the microphone sensitivity. Preferably, the spacing 128 (see FIG. 5) is between about 2 and 4 feet. Of course, individual speakers and microphones may be separately arrayed along the window station 24 of FIG. 2 rather than united into combination speaker/microphone units 76.

The window station 24 may be configured to be of sufficient length to accommodate more than one vehicle 42 at any time, and several food preparers 72 may prepare several orders simultaneously. In such cases, each speaker/microphone unit 76 may be separately connected to a single headset 80 for communication between a customer 26 and one of the food preparers 72. Thus, each customer 26 may communicate with a single food preparer 72.

In one aspect of the invention, heating cables 92 (FIG. 3) are shown embedded in the driveway 22 as a safety feature for melting ice and snow during the winter season.

A curb 82 is shown along the wall 12A to prevent a vehicle 42 from ramming the wall 12A or speaker/microphones 76.

In FIG. 4, a foundation 110 with footing 112 is shown in the ground 113, supporting wall 12A and the restaurant floor 94. In FIG. 4, menu boards 56C are shown suspended from ceiling 114 by arms 116 and angled for direct viewing by a customer 26 in vehicle 42.

Also shown in FIG. 4 is a canopy 40 over the driveway 22 of the window station 24. A representative interior light 122 and exterior lights 120 are shown suspended from the ceiling 114 and canopy 40, respectively. The canopy 40 extends over a major portion of the driveway 22 in the station 24, protecting the vehicle 42, customer 26, and windows 30, 32 from both precipitation and hot solar radiation. The canopy 40 also visually darkens the exterior of the windows 30, 32 to enhance visibility through the windows from the exterior. The canopy 40 is depicted as an extension of the overhang 11, having a decorative face 13 of the same vertical dimension 15.

As illustrated in FIG. 4, the driveway elevation 70 is higher than the elevation 96 of the floor 94 in the food preparation area 34 by a difference 98 between about 5 and 26 inches. In most cases, the elevation difference is between about 6 and 20 inches.

The most critical dimension relating to this invention is the difference 104 between the customer eye elevation 106 and the elevation 102 of the food preparation surface(s). This difference 104 in elevation of the customer's eyes 126 above the food preparation surface 36 should be between about 6 and about 30 inches, preferably between about 8 and 25 inches, and more preferably between about 10 and 22 inches.

Expressed another way, the overall viewing angle 108 by a customer 26 looking through a viewing window 30 extends from the upper edge 123 of the menu boards downward to include the lower edge 124 of viewing window 30, the viewing angle 108 having its vertex in the customer's eye 126. The customer eye elevation 106 is intermediate the menu board(s) and the food preparation surface 36. Looking somewhat upwardly through viewing window 30, the customer 26 can see the menu board(s). The customer 26 looks somewhat downward through the viewing window 30 to see the food selections and food preparation steps carried out on the food preparation surface 36.

For customer comfort, the viewing angle 108 is minimized by lowering the menu board(s) relative to the customer eye elevation 106. In the embodiment of FIG. 4, the viewing angle 108 is generally less than about 100 degrees, and may be reduced to less than about 80 degrees without sacrificing other advantages. This analysis assumes that the customer 26 is seated in a vehicle 42 such that the customer's eyes 126 are about 1.5 to 4 horizontal feet from the viewing window 30.

Typically, the food preparation surface 36 is 36–40 inches above the floor 94.

The eye elevation 106 of a vehicle driver or passenger 26 above the driving surface, i.e. driveway 22 is a function of the particular vehicle 42 and the stature of the driver or passenger. Vehicles 42, whether sedans, vans, pickup trucks, small sport cars, sport vehicles such as four-wheel drive vehicles, etc. vary in the seating height of driver and passengers. Trucks, vans, and sport vehicles generally have a more elevated seating height than conventional sedans or sport cars. In addition, some vehicles are modified by raising the body relative to the chassis. An accommodation to larger vehicles is not specifically illustrated, but is within the scope of the invention, being generally accomplished by simple modification of the restaurant dimensions.

For the vast majority of automobiles and pickup trucks in the United States, the driver's eyes will generally be between about 40 and 60 inches above the driveway elevation 70. The elevation 106 of a driver's eyes 126 are, of course, affected by the stature of the customer 26, the range of variation being of the order of up to about 8 inches or more.

The difference 100 between the driveway elevation 70 and the elevation 102 of the food preparation surface(s) 36 is typically between about 16 and 33 inches for best viewing by a customer 26 in an average vehicle 42. As already stated, the difference 98 between the driveway elevation 70 and restaurant floor elevation 96 is generally between 5 and 26 inches, the driveway 22 being higher than the floor 94.

Thus, in this invention, the difference 98 between driveway elevation 70 and floor elevation 96 is provided which accommodates nearly all automobiles and pickups, and includes customers 26 having varied stature. Present drive-through restaurants generally do not provide sufficient space for large trucks and industrial or large farming vehicles, and accommodation to the general use of such vehicles at this drive-through station 24 is not specifically illustrated, although a modified restaurant construction accommodating larger trucks is possible and within the scope of this invention.

Pedestrians and persons on motorcycles and bicycles may easily use the viewing window 30, while persons on snowmobiles (where such is permitted) must generally first dismount and stand at the window (or interior counter if any) to place and receive an order. Advantages accrue for both vehicular customers and pedestrian customers in the practice of this invention.

The driveway elevation 70 may be formed at a higher level than the restaurant floor 94 by raising the driveway 22 above the surrounding ground level and/or by depressing the restaurant floor 94 to a sub-normal level 96 or by a combination thereof. Where the ground is not level, use may be made of the natural variations to form the elevated driveway 22.

Figure 6:
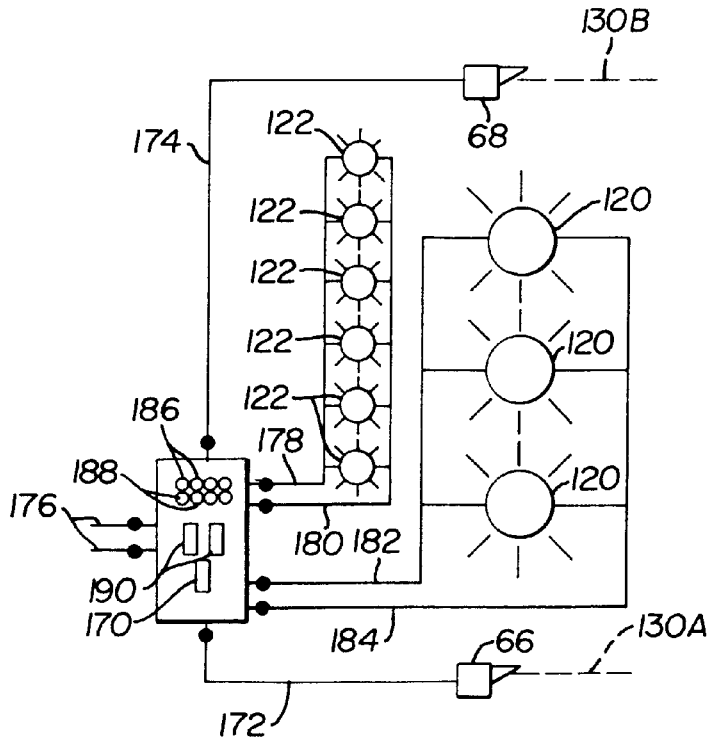
FIG. 6 is a schematic view of a lighting control system for a drive-through restaurant window station of the invention.

One feature of the drive-through window station 24 is an automated lighting system for changing internal and/or external illumination levels when a vehicle enters and leaves the station 24. As shown in FIGS. 3, 5, and 6, an entrance sensor 66 and exit sensor 68 may be activated by interruption by an intervening vehicle of a light beam 130A, 130B, respectively from a mirror or light emitter 132 or 134. The sensors 66, 68 are connected through cables 172, 174, respectively to a controller 170. Electrical power is provided via cables 176 at line voltage, e.g. 120 volts AC.

Interior incandescent lights 122 are connected to the controller 170 by conductors 178 and 180 for operation generally at normal line voltage or slightly lower to achieve a high illumination level and at a lower voltage for a lower illumination level.

Likewise, incandescent exterior lights 120 are connected to the controller 170 by conductors 182 and 184 for operation at a high voltage for a high illumination level and at a lower voltage for a lower illumination level. The voltage levels may be preset to control the interior lights 122 and/or exterior lights 120 at desired high and low illumination levels. In one embodiment, the interior lights 122 and exterior lights 120 are incandescent lamps which may be controlled between high illumination levels and low illumination levels by integral or in-line switches, not shown. The entrance sensor 66 is positioned to sense an incoming vehicle 42 and turn the interior lights 122 to a higher illumination level. Optionally, the exterior lights 120 may also simultaneously be either increased or decreased in brightness by varying the voltage thereto. In any case, the interior illumination is controlled to be brighter than the exterior illumination while a vehicle is present on the driveway 22 so that the menu boards 56, which may or may not be back lit to adjust the illumination level, and also food preparation surfaces 36 are readily visible to a customer looking through viewing window 30 from the driveway.

The controller 170 is actuated by inlet sensor 66 to increase the voltage to lights 120 and/or 122 when the light beam 130A is interrupted. Similarly, the controller 170 is actuated by exit sensor 68 to decrease the voltage to lights 120 and/or 122 when the light beam 130B is interrupted.

Controller 170 may include manually actuated rheostat controls 186 for varying pre-set voltage levels to lights 120, 122, and delay timer controls 188 for delaying the changes in voltage. Manual override switches 190 are also depicted. The particular controller circuits for providing various voltage control sequences are well known in the art.

Sensors 66, 68 based on principles other than light beam interruption may alternatively be used, and the particular circuitry within controller 170 may be varied.

In the event the restaurant utilizes only florescent lighting, a first set of florescent lights will be maintained in an ON configuration at all times during business hours. An additional set of lights 120, 122 is turned ON and OFF in response to the sensors 66,68, thereby achieving the variable illumination.

Controlling the illumination as described has several advantages:

1. The entrance of a vehicle 42 into the window station 24 is signalled to the restaurant employees by the sudden increase in illumination, indicating that an employee should be prepared to accept a food order by intercom.
2. The reduction in illumination during no-customer periods saves energy.
3. The increased exterior illumination provides a sense of control to the customer, providing extra light when looking for money to pay for the order, and when looking in or at the meal preparation and packaging. The correct preparation of a food order is more easily determined.
4. The alternating high and low illumination levels may attract attention from passing motorists, thereby increasing business.

The exterior lights 120 may use lamps which radiate illumination having a wavelength non-attractive to insects. Such lamps are commercially available.

In a further variation, insect attracting lights 121 are positioned on or near the outer face 13 of the canopy 40, so that those insects which may be present in the window station 24 are attracted away from the windows 30 and 32.

It is understood that viewing window 30 may be a single continuous window or may alternatively comprise a series of smaller windows extending over an equivalent area to provide essentially a full view of the food preparation and packaging operations to a customer 26 in a vehicle 42.

Typically, the window 30 is an insulating window having a pane 54 (see FIG. 5) of multiple parallel glass or plastic sheets. The panes 54 may be tinted to reflect solar radiation, but are not so darkened as to interfere with the customer's view of food preparation activities from an exterior vehicle 42. As already indicated, the interior is brightly lit for customers to view the food preparation through the window 30. Where an optional canopy 40 is used, the external area adjacent the viewing window 30 is thereby darkened relative to unprotected areas. Thus, on bright sunny days, the necessary relative illumination exterior and interior the windows 30 and 32 may be maintained for good viewing by a customer 26.

Figure 7:
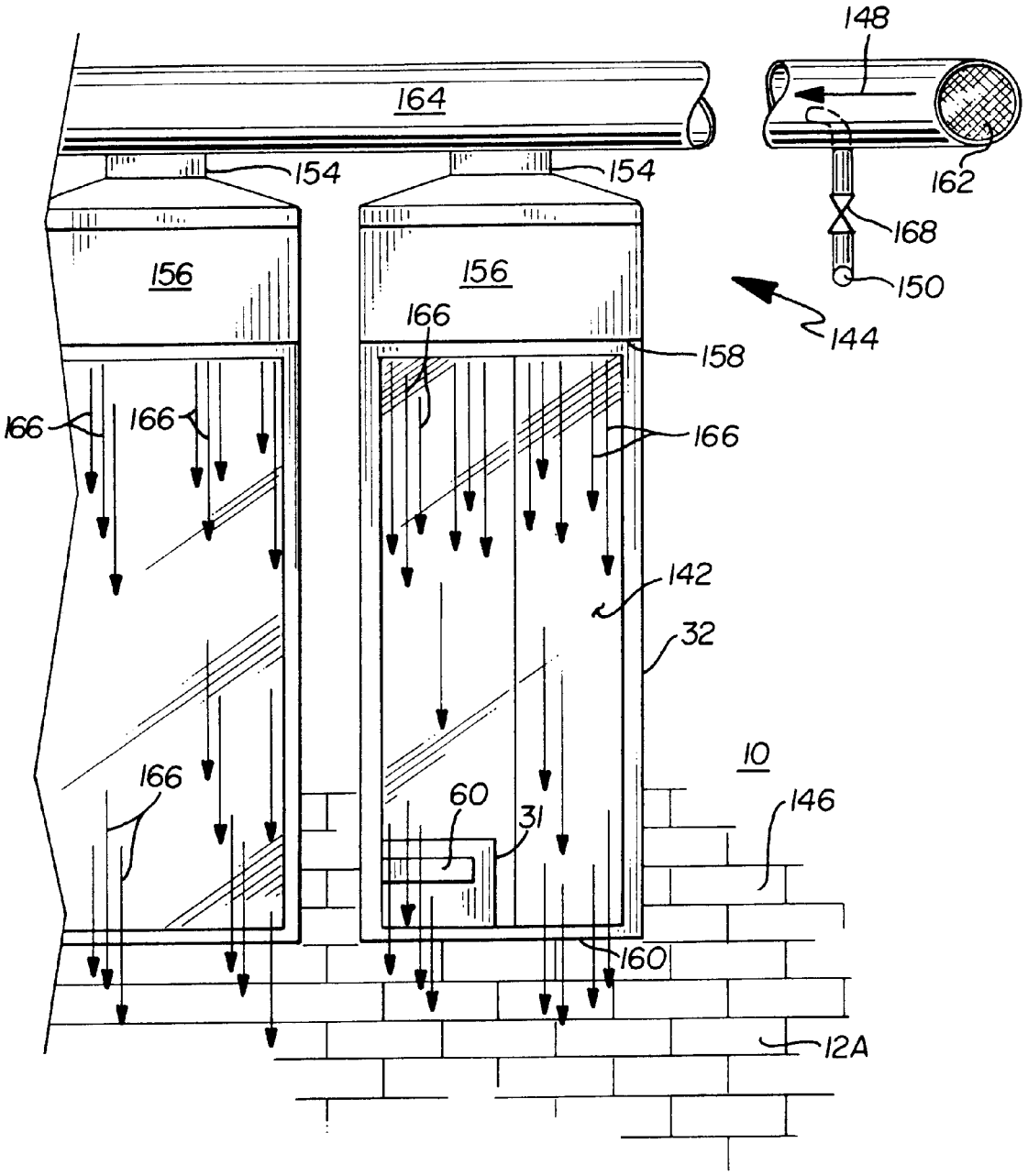
FIG. 7 is a partial front view of a viewing window and a delivery window of a drive-through restaurant window station of the invention.

In a further feature depicted in FIG. 7, a delivery window 32 in wall 12A has a horizontally movable pane 142 and a stationary pane 140, which can be on either side. Moveable and stationary panes 142 and 140 may be reversed to suit the needs of the restaurant. Alternatively, a commercially made drive-through window can be used.

In some areas, mayflies or other insects may be present in high populations during certain periods of the year. One aspect of this invention is apparatus for blowing insects from the exterior of windows 30 and/or 32.

Shown schematically is an air flow apparatus 144 installed within wall 12A, on the surface 146 of wall 12A, or below the canopy 40. The air flow apparatus provides a moderate or high velocity flow of air 166 parallel to, adjacent to and coextensive with window 32, and preferably with window 30 as well. Fresh air 148 is drawn by a fan 154 from an exterior inlet 162 remote from the driveway 22 and windows 30, 32. As depicted in FIG. 7, the air 148 is drawn through ducts 164, through one or more flow directing passages 156 and driven across the windows 30 and 32 as flow 166 at a velocity which will remove insects from the window surfaces, or prevent their accumulation. As shown in exemplary FIG. 7, the flow of air 166 emerges near the upper edge 158 of window 32 and continues downward across window 32 past the lower edge 160 of the window and passes into the atmosphere. In one embodiment of the invention, air 150 from inside the restaurant 10 containing aromas of food undergoing preparation is added or injected via a separate pathway (not shown) to the fresh air 148 blown over the window(s) as airflow 166. As airflow 166 blows across the window(s) and into the driveway area, these aromas are released into the exterior air to enhance the appetites of customers. The quantity of aromatic interior air 150 added to the fresh air 148 is controlled by valve 168.

The airflow 166 also acts as an insulating layer over an open or closed window and prevents the entry of insects and windblown dust as well as automobile exhaust fumes into the restaurant interior.

In another embodiment of the invention, not shown, open fans may be placed at locations above or to the sides of windows 30, 32 for directing a high velocity stream of air over the window(s). Fans may be suspended from the canopy within up to 4 feet from the windows 30, 32. However, it is preferred to draw air from a remote location 162 having much reduced concentrations of vehicle exhaust gases.

The figures depict a restaurant window station 24 for vehicles 42 driven from the left hand side. In countries where the driver's side 48 of vehicles 42 is, by convention, on the right hand side, the restaurant window station 24 would be specifically configured to accommodate such vehicles. In such countries, the restaurant window station 24 is a mirror image of that shown in the figures.

A number of major benefits derive from practice of the invention, among which are the following:

First, a complex meal item may be prepared to the order of a vehicle-bound customer, with the customer viewing the preparation and providing specific information concerning the order. The customer may also view the packaging and order particular condiments or additional foods, as well as utensils, napkins, straws, chips, cookies, promotional items, etc. Thus, errors in the final delivered customer order are avoided.

Second, the number of re-orders is greatly decreased. Extra time consumed in reorders is largely eliminated, thereby increasing the overall food delivery capacity.

Third, the quantity of food wasted because of preparation error is greatly reduced.

Fourth, the menu board above the food preparation area is positioned at a lower elevation relative to the customer. Thus, the customer does not need to lift his/her head as much to view the menu board.

Fifth, the customer has full view of the food preparation area and chooses particular displayed items. Thus, the restaurant employee can encourage additional purchases and also is motivated to display and use only high quality, attractive food items and/or other merchandise offered for sale. Additional items may be sold to enhance and increase sales for the restaurant. This has not been possible with the current drive-through arrangements to date.

Sixth, the invention allows a customer enhanced control over the food preparation process and provides a full assortment of choices for the customer during the ordering and packaging process from beginning to end, improving customer relations.

Seventh, the brightening illumination provides a visual "welcome" to a customer entering the restaurant station 24.

Eighth, use of a moving air film over the viewing window 30 and the delivery window 32 as described prevents the accumulation of insects on the windows and the entry of insects into the restaurant 10 and also may be used to provide appetite-enhancing aromas using inside air from the restaurant in conjunction with the air film.

It is anticipated that various changes and modifications may be made in the construction, arrangement, operation and method of construction of the drive-through restaurant station and windows disclosed herein without departing from the spirit and scope of the invention as defined in the following claims.

What is claimed is:

1. A drive-through restaurant, comprising:

a structure having a floor at a first elevation and an interior and an exterior, and a roof and walls having interior and exterior surfaces;

an elongated food preparation surface adjacent and parallel one of said interior wall surfaces of one of said walls for preparation of a multicomponent food item by a food preparer, said food preparation surface having a second elevation;

an elongated viewing window in said one wall, said viewing window extending along said food preparation surface and having upper and lower edges; and a vehicle driveway exterior said one wall and extending therealong for passage of a vehicle and driver thereof therealong, said driveway having an upper surface at a third elevation higher than said first elevation whereby said food preparation surface is visible through said viewing window to said driver in said vehicle while on said driveway.

2. The drive-through restaurant of claim 1, wherein said second elevation is about 8 to 36 inches higher than said third elevation.

3. The drive-through restaurant of claim 1, wherein said second elevation is about 12 to 33 inches higher than said third elevation.

4. The drive-through restaurant of claim 1, wherein said lower edge of said viewing window is at a level no higher than about 0.5 foot above said second elevation.

5. The drive-through restaurant of claim 1, further comprising a menu board positioned for viewing by the driver in the vehicle.

6. The drive-through restaurant of claim 1, further comprising electric two-way communication means whereby said driver in said vehicle and said food preparer may continuously communicate therebetween during ordering and preparation of food by said food preparer.

7. The drive-through restaurant of claim 6, wherein said communication means includes a plurality of speakers and microphones spacedly arrayed along said exterior wall surface for maintaining continuous communication as the vehicle moves along said driveway.

8. The drive-through restaurant of claim 7, wherein said speakers and microphones are arrayed along said exterior wall surface at a spacing of about 2–10 feet.

9. The drive-through restaurant of claim 7, wherein said speakers and microphones are arrayed along said exterior wall surface at a spacing of about 2–4 feet.

10. The drive-through restaurant of claim 7, wherein said speakers and microphones are positioned on said exterior surface of said one wall at an elevation below the lower edge of said viewing window.

11. The drive-through restaurant of claim 6, wherein said communication means comprise speaker-microphone units, each said speaker-microphone unit including a speaker and a microphone.

12. The drive-through restaurant of claim 1, wherein said viewing window is non-openable.

13. The drive-through restaurant of claim 1, further comprising an openable delivery window for delivery of food to the driver.

14. The drive-through restaurant of claim 13, further comprising means for providing a controllable flow curtain of air across at least one of said windows.

15. The drive-through restaurant of claim 14, wherein said means for providing a flow curtain moves said air across said delivery window.

16. The drive-through restaurant of claim 14, wherein said air is obtained from the atmosphere at a location remote from said vehicle driveway, said viewing window and said delivery window.

17. The drive-through restaurant of claim 14, wherein said means for providing a controllable flow curtain comprises at least one fan mounted to direct air past at least one of said viewing window and said delivery window.

18. The drive-through restaurant of claim 14, wherein air from interior said restaurant is injected into said flow curtain for providing food preparation aroma exterior said restaurant.

19. The drive-through restaurant of claim 1, further comprising a protective canopy extending over said driveway adjacent said viewing window at an elevation permitting passage of vehicles beneath.

20. The drive-through restaurant of claim 19, wherein said canopy extends from said one wall over said driveway at an elevation of at least 9 feet above said driveway.

21. The drive-through restaurant of claim 19, wherein said canopy has an outer edge away from said one wall, said outer edge including a plurality of electric lamps emitting light at insect attracting wavelengths.

22. The drive-through restaurant of claim 1, further comprising:

exterior lights for illuminating said driveway exterior said viewing window;

interior lights for illuminating said interior of restaurant adjacent said viewing window; and means for controlling at least one of said exterior lights and interior lights wherein the illumination interior said viewing window is greater than the illumination exterior said viewing window when a vehicle is present on said driveway.

23. The drive-through restaurant of claim 22, further comprising:

interior electric lights for illuminating said interior of restaurant adjacent said viewing window, said interior lights operable between an upper voltage level and a lower voltage level;

sensor means for detecting a vehicle on said driveway adjacent said viewing window;

means for increasing said voltage to said interior lights to said upper level to increase interior illumination when a vehicle entering said driveway is detected by said sensor means and for decreasing said voltage to said interior lights to said lower level to reduce said interior illumination when said sensor detects no vehicle on said driveway.

24. The drive-through restaurant of claim 1, further comprising:

interior electric lights for illuminating said interior of the restaurant adjacent said viewing window, said interior lights operable between a first upper voltage level and a first lower voltage level;

exterior electric lights for illuminating said exterior of the restaurant adjacent said viewing window, said exterior lights operable between a second upper voltage level and a second lower voltage level;

sensor means for detecting a vehicle on said driveway adjacent said viewing window;

means for increasing said voltage to said interior and said exterior lights to said first and second upper levels, respectively to increase interior illumination when a vehicle entering said driveway is detected by said sensor means and for decreasing said voltage to said interior and exterior lights to said first and second lower levels, respectively, to reduce said interior and exterior illumination when said sensor detects no vehicle on said driveway.

25. The drive-through restaurant of claim 24, wherein said sensor means comprises a first sensor for detecting a vehicle entering said driveway and a second sensor for detecting a vehicle leaving said driveway.

26. The drive-through restaurant of claim 1, wherein said driveway includes heating cables therein for melting snow and ice on said driveway.

27. The drive-through restaurant of claim 1, further comprising vehicle sensor means positioned along said driveway.

28. The drive-through restaurant of claim 27, further comprising:

exterior electric lights for illuminating said driveway exterior said viewing window, said exterior lights operable at a lower voltage level and an upper voltage level;

means for increasing said voltage to said exterior lights from said lower level to said upper level to increase exterior illumination when a vehicle entering said driveway is detected by said sensor means and for decreasing said voltage to said exterior lights from said upper level to said lower level to reduce said exterior illumination when no vehicle is in said driveway.

29. A drive-through window station for a restaurant, comprising:

a structure having a floor at a first elevation, a ceiling and at least one wall having interior and exterior surfaces;

a food preparation area adjacent an interior surface of one of said walls, and having a food preparation surface elevated above said floor, said food preparation surface usable for preparation of a meal by a meal preparer and having a second elevation;

a first transparent viewing window in said one wall above said food preparation surface;

an openable second window for delivery of prepared food to an occupant of a vehicle outside said second window; and a vehicle driveway passing adjacent said exterior surface of said one wall at a third elevation higher than said first elevation, whereby said occupant of the vehicle on said driveway may look downward through said first transparent viewing window onto said food preparation surface.

30. The drive-through window station of claim 29, wherein said third elevation is between about 5 and 23 inches higher than said first elevation.

31. The drive-through window station of claim 29, wherein said third elevation is between about 6 and 18 inches higher than said first elevation.

32. The drive-through window station of claim 29, further comprising two-way communication means whereby the vehicle occupant and the meal preparer may communicate.

33. The dive-through window station of claim 32, wherein said communication means comprises two-way speaker/microphones external to and internal to said one wall.

34. The drive-through window station of claim 33, wherein said communication means includes a plurality of two-way speaker/microphones spaced apart along the external surface of said one wall adjacent said viewing window wherein uninterrupted communication may be performed therealong between the customer and the meal preparer as said vehicle progressively passes adjacent said first transparent window from said first end of said viewing window to said second window.

35. The drive-through window station of claim 34, wherein said two-way speaker/microphones are spaced apart a distance between about 2 and 10 feet.

36. The drive-through window station of claim 34, wherein said two-way speaker/microphones are spaced apart a distance between about 2 and 4 feet.

37. The drive-through window station of claim 33, wherein said two-way speaker/microphone internal to said one wall comprises a head set configured to be worn by the meal preparer.

38. The drive-through window station of claim 29, further comprising:

interior light means configured to illuminate said food preparation area, said interior light means controllable between a first high illumination level and a first low illumination level; and exterior light means configured to illuminate said driveway adjacent said viewing window, said exterior light means controllable between a second high illumination level and a second low illumination level.

39. The drive-through window station of claim 38, further including first vehicle sensing means configured to sense a vehicle at said window station and activate at least one said light means.

40. The drive-through window station of claim 39, wherein said first sensing means activates said interior light means to a high illumination level when a vehicle is sensed at said window station.

41. The drive-through window station of claim 39, wherein said first sensing means activates said exterior light means to a high illumination level when a vehicle is sensed at said window station.

42. The drive-through window station of claim 39, wherein said first sensing means activates said exterior light means to a low illumination level when a vehicle is sensed at said window station.

43. The drive-through window station of claim 39, further comprising:

driveway lighting means to illuminate said driveway for vehicles approaching said window station; and second sensing means to sense a vehicle entering said driveway and activate said driveway lighting means.

44. The drive-through window station of claim 43, wherein said second sensing means activates said driveway lighting means from a low illumination level to a high illumination level.

45. The drive-through window station of claim 43, wherein said second sensing means activates said driveway lighting means from a high illumination level to a low illumination level.

* * * * *